US006328503B1

(12) United States Patent
Fujiwara

(10) Patent No.: US 6,328,503 B1
(45) Date of Patent: Dec. 11, 2001

(54) METHOD FOR CONSTRUCTING AN UNDERGROUND STRUCTURE

(75) Inventor: Akio Fujiwara, Chiba (JP)

(73) Assignee: Yuy Architects and Engineers Co., Ltd., Tokyo (JP)

( * ) Notice: Subject to any disclaimer, the term of this patent is extended or adjusted under 35 U.S.C. 154(b) by 0 days.

(21) Appl. No.: 09/367,756

(22) PCT Filed: Feb. 19, 1998

(86) PCT No.: PCT/JP98/00681

§ 371 Date: Aug. 18, 1999

§ 102(e) Date: Aug. 18, 1999

(87) PCT Pub. No.: WO98/37279

PCT Pub. Date: Aug. 27, 1998

(30) Foreign Application Priority Data

Feb. 19, 1997 (JP) ..... 9-050961

(51) Int. Cl.[7] ..... E02D 5/18

(52) U.S. Cl. ..... 405/267; 405/266; 405/275

(58) Field of Search ..... 405/266, 267, 405/282, 283, 128, 129, 274, 276, 233, 239, 245, 250, 251, 257, 272, 275; 37/352, 353, 355, 462, 464, 465; 111/106, 114

(56) References Cited

U.S. PATENT DOCUMENTS

| | | | | |
|---|---|---|---|---|
| 3,854,265 | * | 12/1974 | Kobayashi et al. | 52/741.12 |
| 3,999,392 | * | 12/1976 | Fukushima et al. | 405/281 |
| 4,681,483 | * | 7/1987 | Camilleri | 405/267 |
| 5,007,244 | * | 4/1991 | Mori | 52/169.6 X |
| 5,097,641 | * | 3/1992 | Hand et al. | 52/101 |
| 5,129,763 | * | 7/1992 | Deusenbery | 405/272 |
| 5,216,863 | * | 6/1993 | Nessa et al. | 52/439 |
| 5,240,348 | * | 8/1993 | Breaux | 405/267 X |
| 5,259,705 | * | 11/1993 | Breaux et al. | 405/267 |
| 5,720,580 | * | 2/1998 | Ryhsen | 405/282 |
| 6,139,225 | * | 10/2000 | Koike et al. | 405/267 |

FOREIGN PATENT DOCUMENTS

| | | | | |
|---|---|---|---|---|
| 34-7974 | | 1/1957 | (JP) . | |
| 48072912 | * | 10/1973 | (JP) . | |
| 58173217 | * | 10/1983 | (JP) . | |
| 1-116188 | | 10/1987 | (JP) . | |
| 03033318 | * | 2/1991 | (JP) | 405/257 |

* cited by examiner

*Primary Examiner*—David Bagnell
*Assistant Examiner*—Jong-Suk Lee
(74) *Attorney, Agent, or Firm*—Fay, Sharpe, Fagan, Minnich & McKee, LLP

(57) ABSTRACT

To construct an underground structure having smooth wall surfaces in a simple, safe and reliable way, plates (11,12) are buried in parallel, and soil and sand (G1) between the plates is removed. If the places where the plates are to be buried are loosened in advance, they can be buried more easily. A strut member (14) is interposed between the plates, which are used as both forms and sheathing. A hollow body, together with steel plates arranged on both sides of the hollow body, is buried into the ground, the bottom of the hollow body is closed with a shutter, the hollow body is drawn up together with soil in it, leaving the steel plates in the ground, and the remaining steel plates are used as both forms and sheathing. Reinforcement bars are disposed in the groove space thereby formed, and concrete is poured to build an underground structure.

9 Claims, 16 Drawing Sheets

METHOD FOR CONSTRUCTING AN UNDERGROUND STRUCTURE

TECHNICAL FIELD

This invention relates to a construction method for underground structures such as basements and a ground excavation method as well as to an excavation equipment and a steel reinforcing bar fixing tool used for said method.

BACKGROUND ART

The conventional practice for constructing underground structures such as basements has been to excavate the ground, erect formwork, pour concrete and backfill.

This method requires use of earth-retaining sheathing to prevent the ground from collapsing and necessitates laborious tasks of erecting formwork, pouring concrete, removing the formwork after the concrete has hardened and backfilling the soil.

An object of this invention is to permit precise construction of underground structures with smooth wall surfaces by using simple equipment.

DISCLOSURE OF THE INVENTION

A plate assembly is driven into the ground in a parallel arrangement and doubles as a formwork and earth-retaining sheathing while the soil between the plates is removed to create a cavity, and steel reinforcement members or a steel-reinforcement cage are placed in position to pour concrete, thereby eliminating need for erection of formwork as it is possible to withdraw and remove at least the plate on the inner wall of the underground structure prior to the hardening of the concrete.

The invention also permits simple execution of the formwork and earth-retaining work in that the plates are aligned with a hollow body and concomitantly driven into the ground, with the plates being left in the ground while the hollow body is withdrawn. The arrangement permits excavation by providing a shutter at the bottom of the hollow body, with the soil being introduced into the cavity and removed as the hollow body is withdrawn with the soil in it. The shutter is opened when the hollow body is buried into the ground and closes when it is drawn soil contained therein.

In more specific terms, the shutter is installed in such a manner as to be capable of rotating at the bottom of the hollow body or at the lower edge of discharge hole, thereby causing the shutter to open and close automatically in accordance with the soil pressure and soil weight.

A different type of shutter is constructed in a shape of a plate structure located alongside of the hollow body in such a manner that when the shutter is driven downward from the top by means of a rod its orientation is changed in horizontal direction by guide members provided in the hollow body and the bottom of the hollow body is sealed off by the shutter.

It is possible to form a groove space to required length by burying the hollow body while connecting the guides with guide joints provided on either side of the hollow body.

The groove space is formed by driving a continuous arrangement of three hollow bodies provided with guide joints into the ground and withdrawing the hollow body in the middle to form a groove space, while the remaining hollow bodies on either side are supported by plates to permit location of a strut member in the space between these plates.

Since a corner can be accurately positioned by means of the guide joints of the hollow body and auxiliary plates in such a manner that the corner can be positioned at any angle, it is possible to form underground structures of diverse shapes.

Reinforcing bars for forming walls of the underground structure include reinforcing bars that form connections with a floor and ceiling reinforcing bars, and the latter are previously coated with a coating and installed in the groove space by bending them, with the coating being removed after the concrete has hardened, thereby exposing the reinforcement bars and extending them in the direction towards the floor and ceiling for connection with the reinforcing bars of the floor and ceiling.

Horizontal reinforcing bars connected by means of fixtures provided with welded-on U-shaped hooks matching the distance between the horizontal reinforcing members are fixed in position to prevent their displacement from the required position under the pressure of the concrete while being poured.

BEST MODE FOR CARRYING OUT THE INVENTION

The invention will be described concretely in accordance with the drawings.

First Embodiment of the Execution Method

Figure 1A:
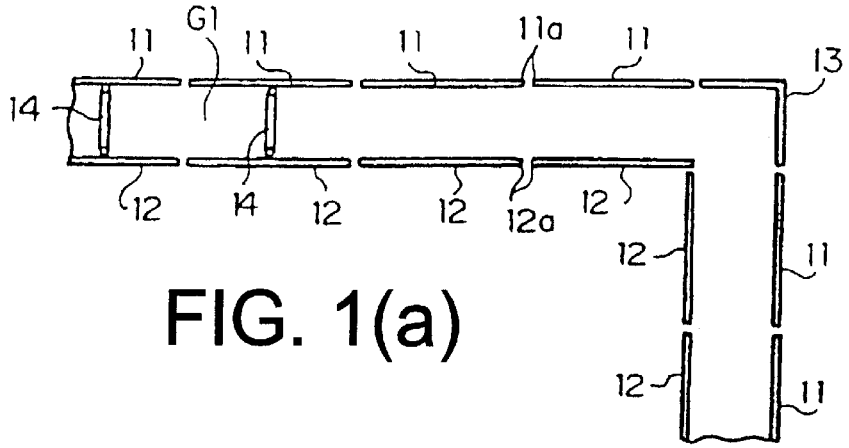
FIG. 1 is an explanatory diagram of a construction method according to the invention.
Figure 1B:
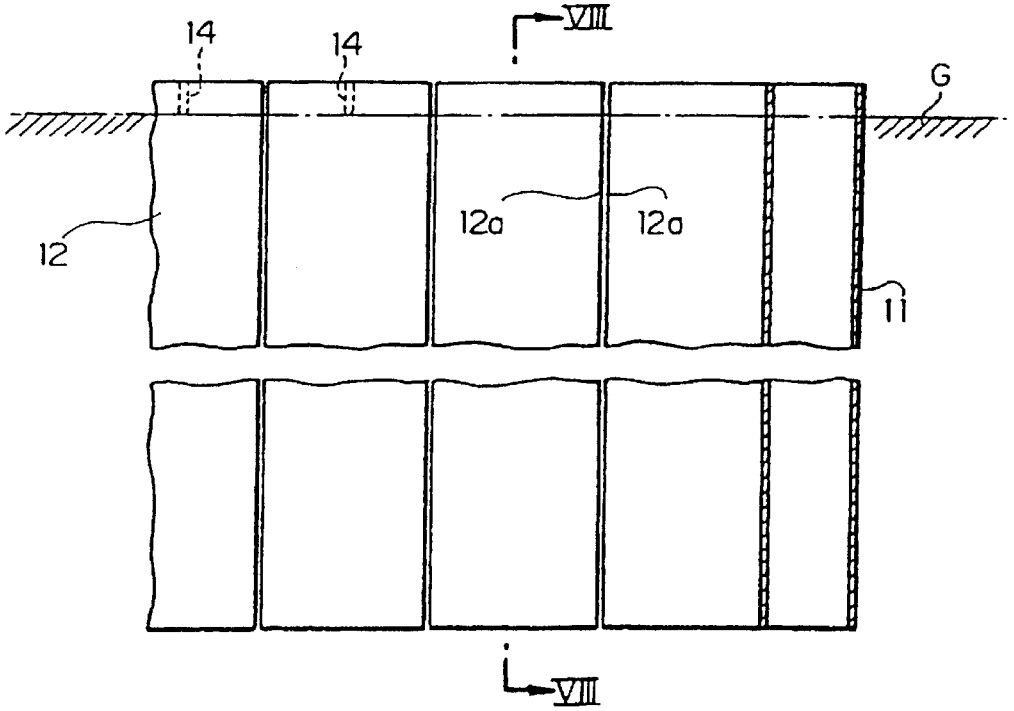
Figure 1C:
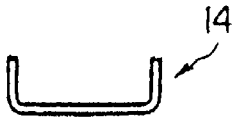

As shown in FIG. 1, steel plates 11 and 12 are first buried into ground G by a suitable means such as compression or impact in accordance with a shape of an underground structure. The ground may be loosened beforehand by a suitable means such as an earth auger or backhoe according to properties of the ground. The plates may also be buried by using an excavator for loosening the ground.

Soil G1 contained in a space between the buried steel plates 11 and 12 is removed and the strut member 14 shown in FIG. 1(*c*) is placed in position to provide a groove space in which said plates 11 and 12 act as both formworks and earth-retaining sheaths.

Reinforcing bars are then arranged in the groove space and the concrete is poured. Before the concrete hardens, said plates 11 and 12 (at least plate 12 on the inner side) are withdrawn for reuse. Since the plates have remained as formworks until immediately prior to the hardening of the concrete, a finished concrete wall has a smooth surf ace and requires no subsequent touchup or repair work to mend detached patches on the wall surface.

As shown in FIG. 1(*a*), a L-shaped plate 13 is used for a corner of the excavated groove, in accordance with a shape of the corner. When a curved corner is constructed, a curved plate is used.

First Embodiment of a Hollow Body

Figure 2:
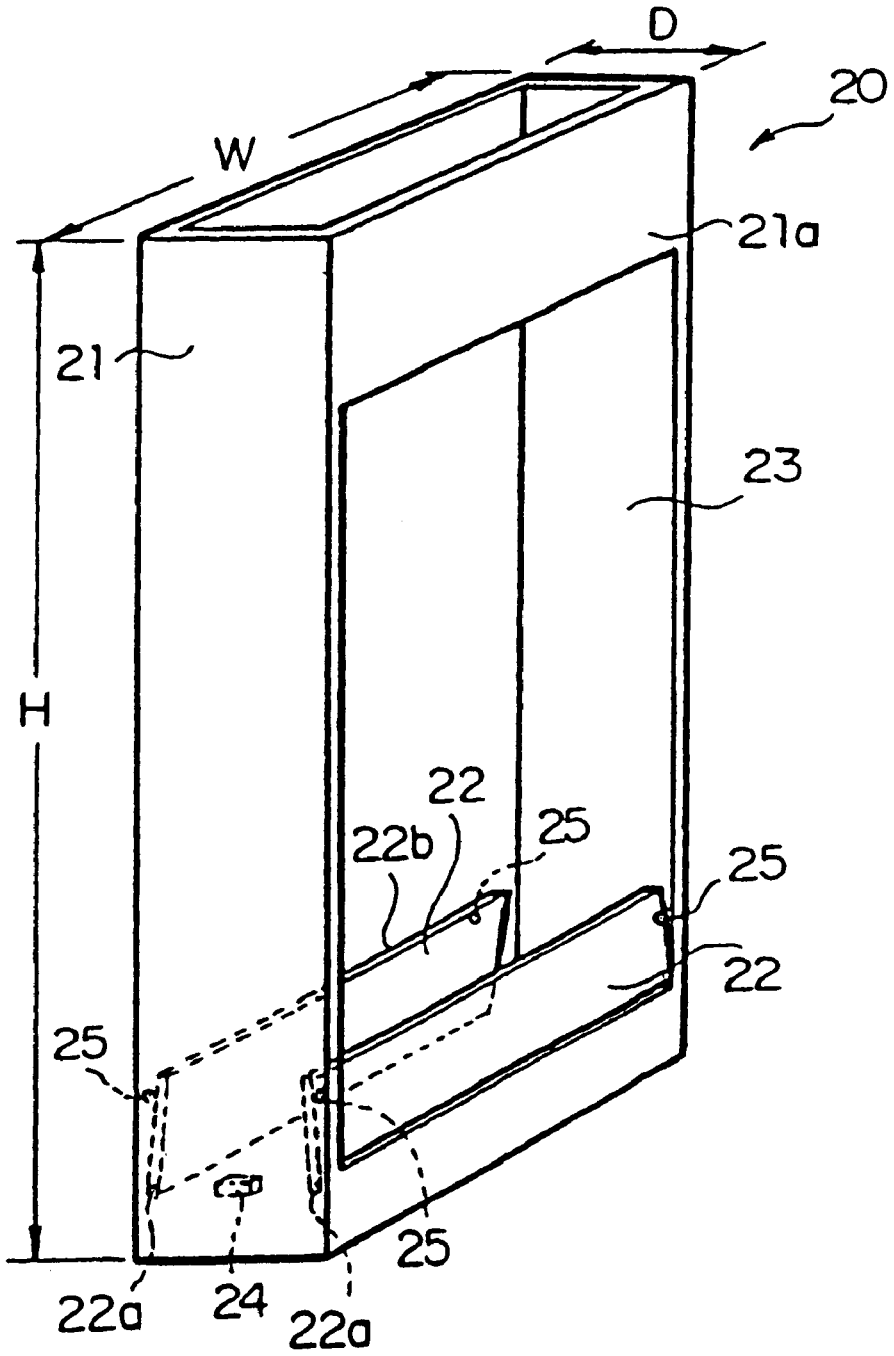
FIG. 2 is a perspective view of a hollow body according to the invention.
Figures 3A, 3B, 3C, 3D:
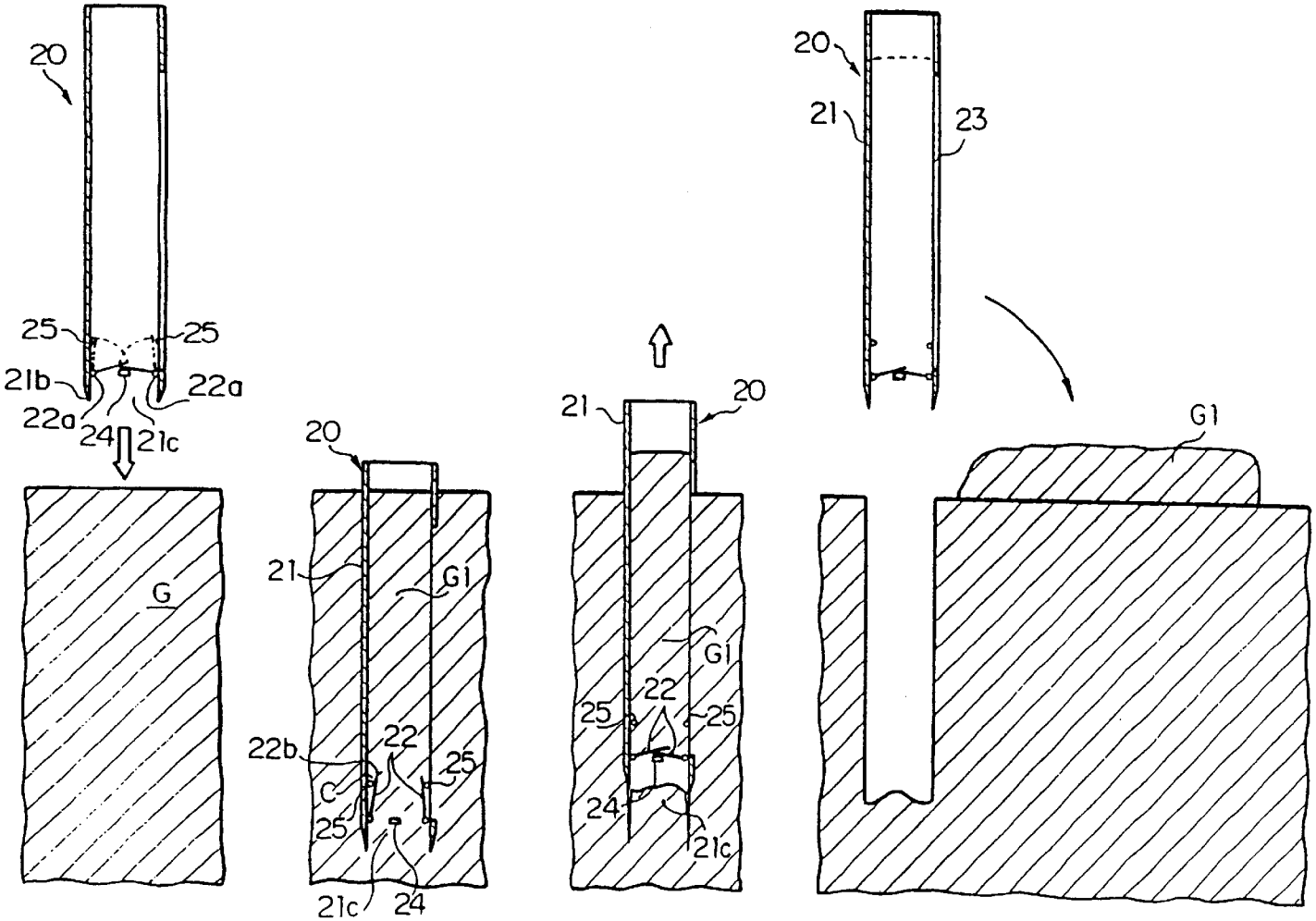
FIG. 3 is an explanatory diagram of a method for using a hollow body.

FIG. 2 is a perspective view of a hollow body according to this invention and FIGS. 3(*a*)–(*d*) are explanatory diagrams of a method in which the invention is applied.

As shown in FIGS. 2 and 3, a hollow body 20 consists of a box-type hollow body 21, a shutter 22, 22 mounted at a bottom of said hollow body 20 in a such a manner as to be capable of rotating with respect to said hollow body, and a discharge hole 23 for removing the soil provided on a lateral wall 21*a* of said hollow body.

The hollow body 20 may be made of materials such as steel, resin, or wood and its dimensions may be in the order of approximately 60 cm in width, approximately 25 cm in depth, and approximately 400 cm in height. These dimensions may be suitably altered to meet actual conditions such as properties of ground to be excavated and a size of a structure to be built.

As shown in FIG. 3(*a*), a bottom edge 21*b* of the hollow body 20 is provided with a sharp border to facilitate penetration into the ground.

The shutter 22 is mounted on hinges 22*a* onto the hollow body beneath the discharge hole 23 to permit its rotating movement, and the range of this rotating movement is limited by a bottom stopper 24 and a top stopper 25 protruding from a inner wall of the hollow body 20.

To excavate, the hollow body 20 is first buried into the ground G with use of some suitable means such as a pressure-driving device as shown in FIGS. 3(*a*) and (*b*).

The shutter 22 rotates upwards as soil enters the hollow bottom thereby opening a aperture 21*c* so that soil G1 enters the inner space of the hollow body as it descends into the ground.

When the hollow body has been buried to specified depth and the hollow body 20 is drawn upward as shown in FIGS. 3(*c*) and (*d*), the shutter 22 rotates downward under weight of the soil filling the inner space of the hollow body, thereby causing the aperture 21*c* to close, so that the soil G1 is withdrawn with the hollow body 20.

As a space is provided between a front edge 22*b* of the shutter 22 and the inner wall of the hollow body, the soil G1 enters into this space and the shutter 22 is closed without fail. The downward rotational movement of the shutter 22 is limited by the bottom stopper 24.

The soil G1 is removed from the discharge hole 23 of the hollow body drawn up to the ground surface and the hollow body is then capable of being reused and buried again.

Second Embodiment of the Hollow Body

Figure 4:
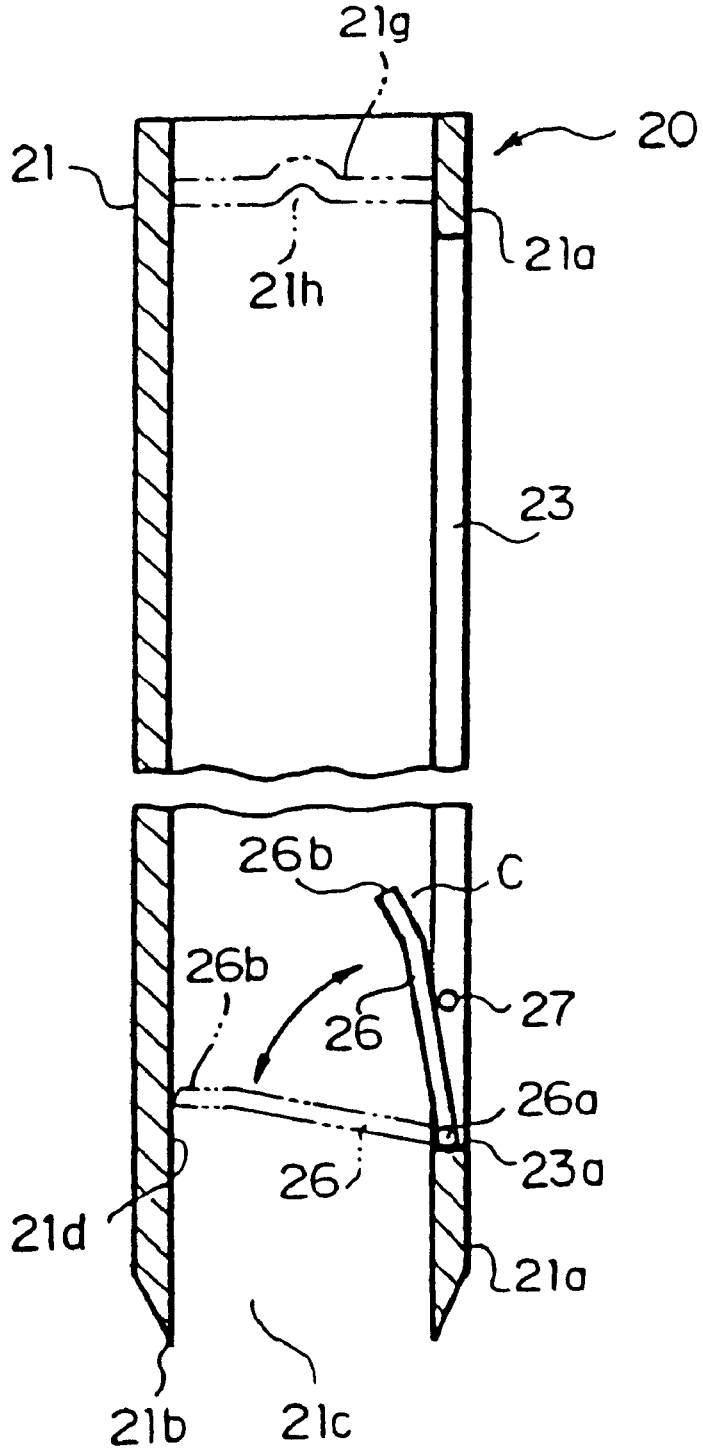
FIG. 4 is a sectional view of another embodiment of the hollow body.

FIG. 4 is a cross-sectional view of the second embodiment of the hollow body according to the invention.

A shutter 26 of this second embodiment is mounted by means of a fixture 26*a* at a bottom edge 23*a* of the discharge hole 23 in such a manner as to permit its rotational movement. Said shutter 26 is limited in its downward rotation as its front edge 26*b* contacts a wall 21*d* on the opposite side of the hollow body 20 as indicated by a imaginary line. Its upward rotational movement is limited by a top stopper 27. When the shutter 26 makes contact with the top stopper 27 as shown by the solid line in FIG. 4, a space is present between the front edge 26*b* of the shutter 26 and the inner wall of the hollow body. When, furthermore, the hollow body is driven into the ground, the fixture 26*a* of the shutter 26 will not act as an obstacle as the front edge 26*b* of the shutter curves (bends) away from the inner wall so that the hollow body can easily be driven into the ground. Moreover, the fixture 26*a* will not be damaged since the soil pressure does not exert a strong action on the fixture 26*a* while the hollow body is being buried.

The following explanations describe excavating conditions.

Figure 5A:
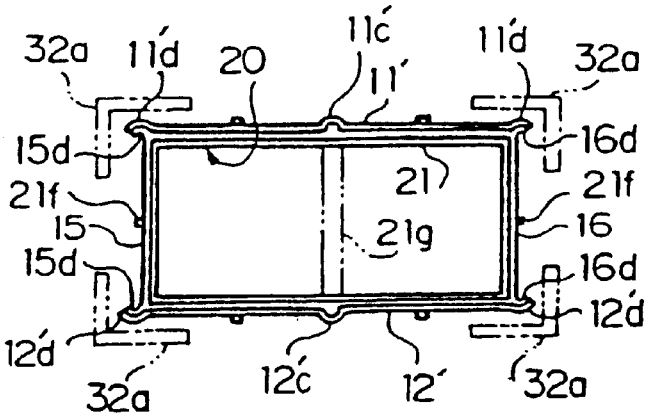
FIG. 5 is an explanatory diagram showing the hollow body with a plate assembly attached thereto.
Figure 5B:
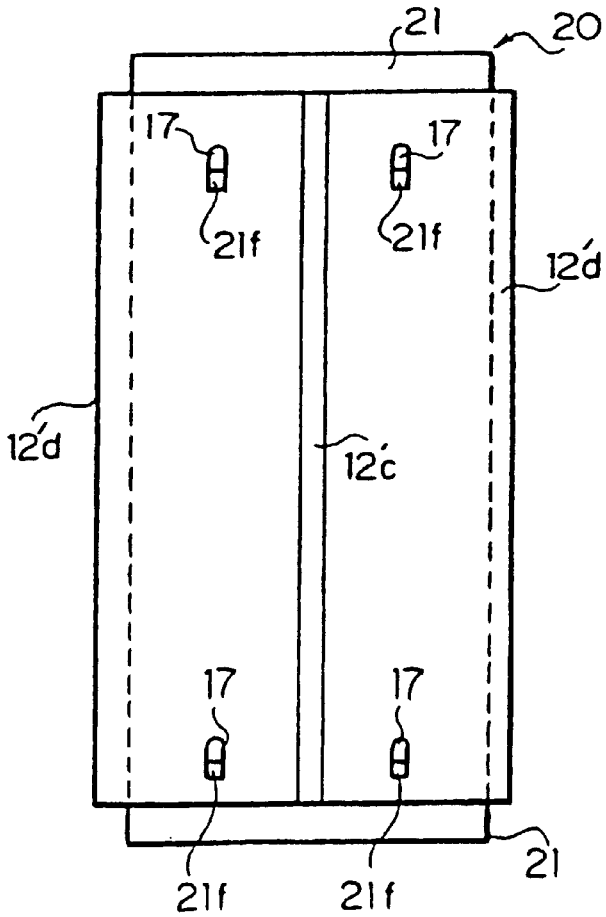
Figures 6A, 6B, 6C:
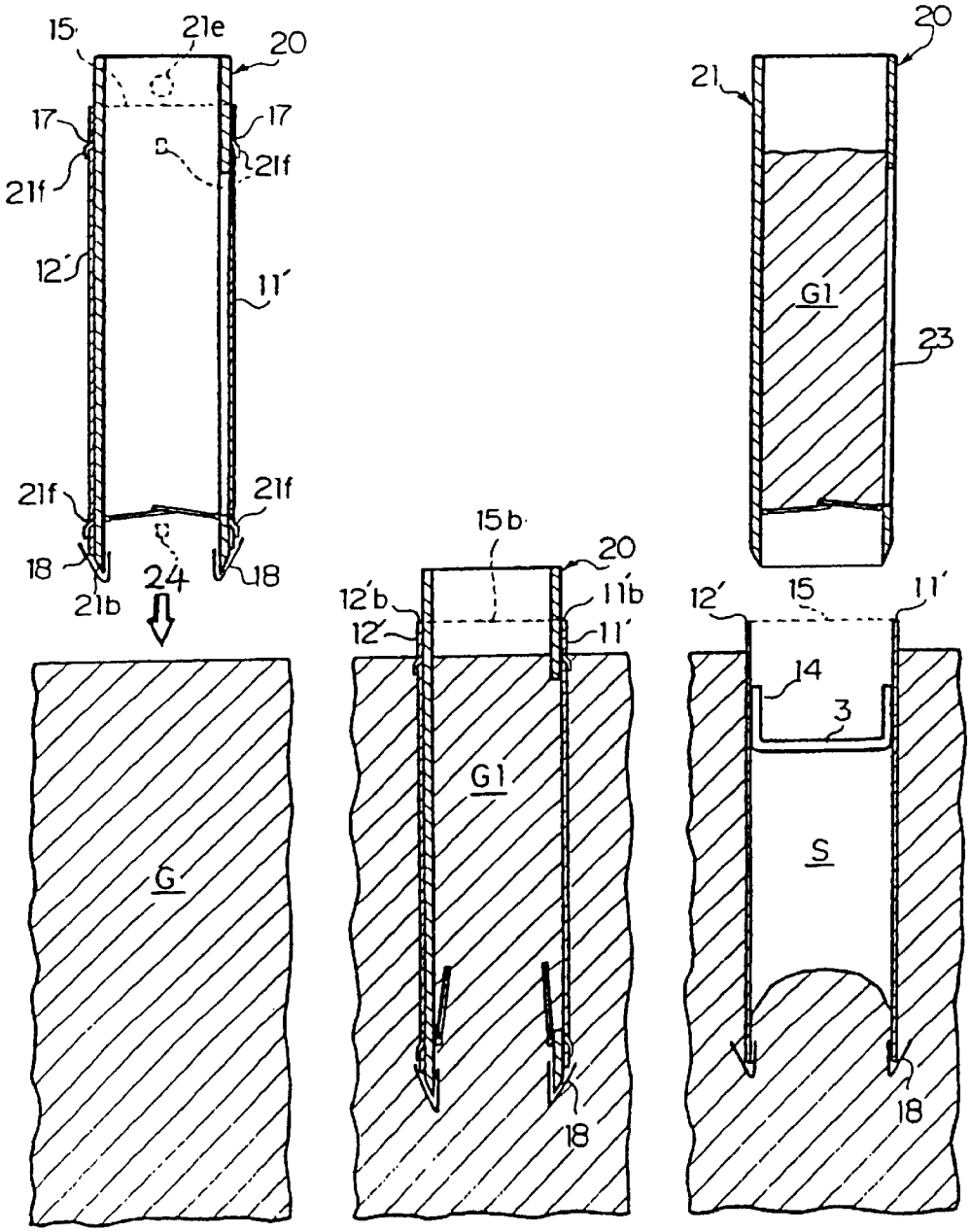
FIG. 6 is an explanatory diagram of an excavation procedure.

As shown in FIGS. 5(*a*) and (*b*), and FIG. 6(*a*), a steel plates 11' and 12' are provisionally mounted on the outer sides of the hollow body 20 while auxiliary plates 15 and 16 are provisionally mounted on the periphery of the hollow body 20. A hook 21*f* provided on the outer side of the lateral walls of the hollow body 20 are engaged into a hole 17 provided on the steel plates 11' and 12' as well as the auxiliary plates 15 and 16. As both sides of the steel plates 11' and 12' and the auxiliary plates 15 and 16 are provided with ribs 11'*d*, 12'*d*, 14*d* and 16*d*, respectively, temporary fastening can be achieved by bringing the ribs into a light meshing engagement one with the other, as shown in FIG. 5(*a*). As is clear from FIG. 5(*a*), the steel plates 11' and 12' are attached after the auxiliary plates 15 and 16 have been attached.

Further, shoes 18 are attached so as to cover the bottom edges 21*b* of the hollow body 20 and the bottom edges of the steel plates 11' and 12' and of the auxiliary plates 15 and 16, as shown in FIG. 6(*a*). The shoes 18 are designed to prevent ingress of soil into the ribs 11*d* and need not therefore be fastened securely but only provisionally, for which even gum-tape may be adequate.

As shown in FIG. 6(*b*), the hollow body 20 and the steel plates 11' and 12' as well as the auxiliary plates 15 and 16 are buried into the ground. The shoes 18 will prevent the soil from entering the space between the hollow body 20 and the steel plate 11'.

When the specified depth has been reached, the top edges 11'*b* and 12'*b* of the steel plates 11' and 12' and the top edges 15*b* and 16*b* of the auxiliary plates 15 and 16 are retained by some suitable means and only the hollow body 20 is withdrawn from the ground, as shown in FIG. 6(*c*) whereas the steel plates 11' and 12' and the auxiliary plates 15 and 16 are left in the ground, thereby forming a groove space S as the soil G1 is removed.

A strut member 14 is pressure-fitted between the steel plates to maintain the space between them by making use of semicircular ribs 11'*c* and 12'*c* in the central part of the steel plates 11' and 12'.

A next hollow body 20 is then buried into the ground by making use of the guide joint of the hollow body 20. By repeating this process, it is possible to obtain a continuous groove space as shown in FIG. 1(*a*).

When the hollow body is withdrawn from the ground, the steel plates 11' and 12' and the auxiliary plates 15 and 16 will remain in the ground and the ribs provided on the edges act as joints to form a closed boundary surface, thereby preventing the collapse, into the groove space S, of the soil in the part that has not yet been excavated. When the groove space adjoining the right side in FIG. 5 (*a*) has been created, the auxiliary plate 16 is raised to remove it and thereby create a continuous space.

When an excavation work is performed in a location with favorable ground conditions and firm soil, it may not be absolutely necessary to install an auxiliary plate, and only the steel plates 11' and 12' may be temporarily buried in the lateral wall parts.

Burying the Hollow Body

Figure 7A:
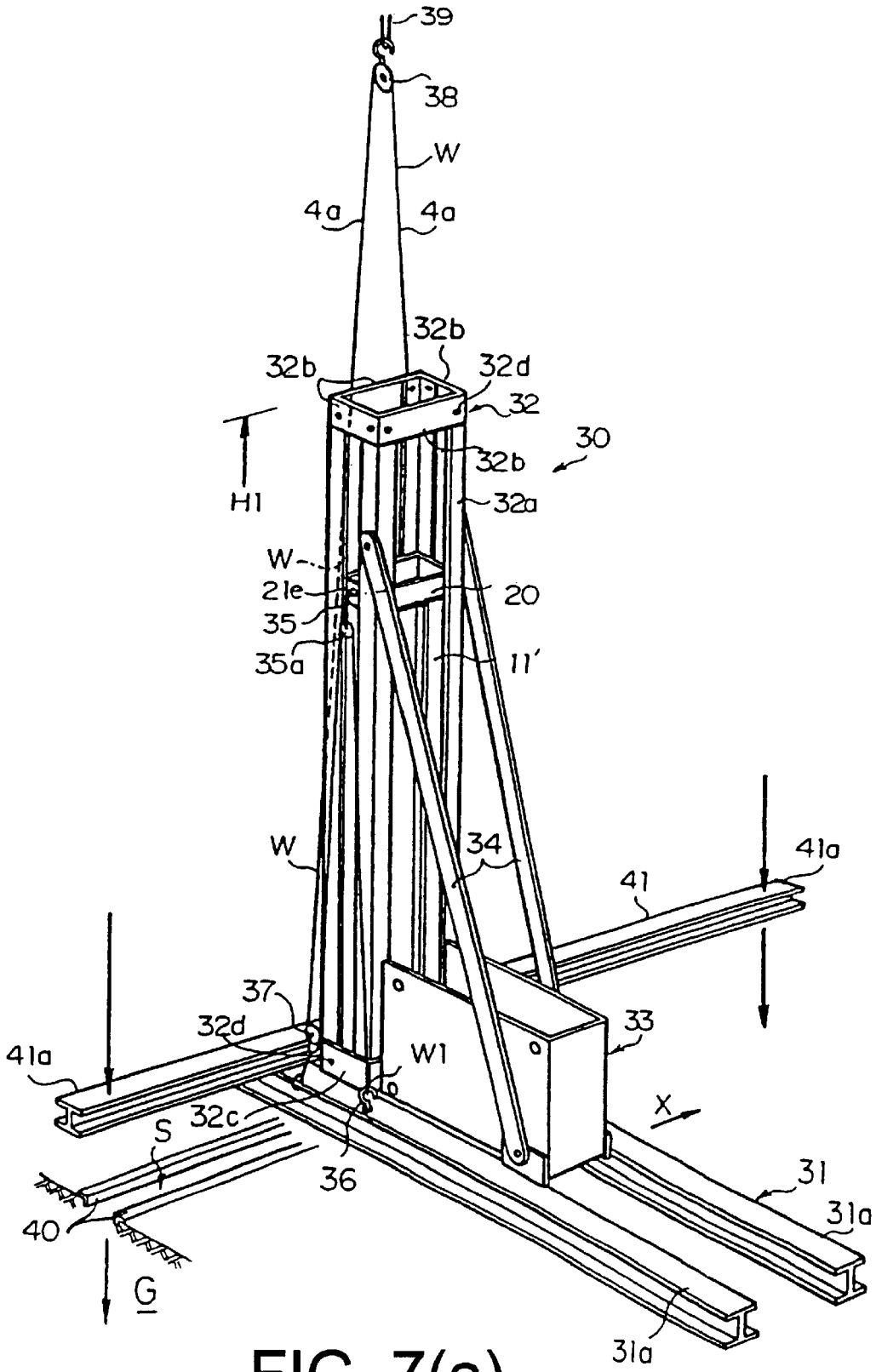
FIG. 7 is an explanatory diagram of a burying equipment.

FIG. 7 is an example of a system used for burying the hollow body 20, with (a) being a perspective view and (b) a schematic showing a principle of action.

In the figure, reference character 30 is a burying system. It is provided with a base 31 and a guide frame 32 positioned thereupon as well as an attachable and detachable bucket 33. The base 31 is formed by two H-section plates arranged parallel to each other.

The guide frame 32 has four pillars 32*a* and coupling members 32*b* and 32*c* linking the upper and lower parts thereof and is secured on the base 31. Oblique members 34 and 34 link the guide frame 32 and the base 31. The hollow body 20 is located in the guide frame 32, as shown in FIG. 5(*a*).

The members forming the guide frame 32 are coupled and secured by means of nuts, bolts and long-holes to permit fine adjustment of their relative positions and thereby adjust perpendicular orientation of the guide frame 32.

A bucket 33 is designed to carry the excavated soil G1 (see FIGS. 3(*d*) and 6(*c*)) and is provided with a lid that is not shown in the figure.

A self-propelled crane (not shown in the figure) is mounted on the base 31 rearward of the bucket 33 (at the front side in the figure). The hollow body 20 (or the hollow body 20 and steel plates 11' etc.) is suspended on the crane and inserted into the frame from the top of the guide frame 32. Holes 21*e* (see FIG. 6(*a*). Only a front hole is shown in FIG. 7) are provided on the hollow body 20, e.g., on the left and right at the top of the hollow body 20. By attaching different hooks from the crane hooks to these holes it is possible to lift the hollow body 20 with the crane. As shown by the imaginary line (21*g*) in FIG. 5(*a*), a rod for lifting and lowering and also for withdrawing the hollow body is fastened and left on the inner side at the top of the hollow body 20. This rod 21*g* is provided with a recesse 21*h* for directly attaching the crane hooks thereto, as shown by the imaginary line in FIG. 4. When the hollow body 20 (or the hollow body 20 and steel plates 11' etc.) is inserted into the guide frame 32, the height of the guide frame 32 is adjusted so that the top of the hollow body (at least the aforementioned hole 21*e*) is positioned farther downward than the coupling member 32*b* at the top of the guide frame. Thus, for example, the height H1 of the guide frame may be adjusted to around 450 cm when the height H of the hollow body is 400 cm. The hooks used while lifting the hollow body are disengaged from holes 21*e* (or rod 21*g*) and pulley hooks 35 and 35 (of which only the lower one is shown in the figure) are attached to holes 21*e* and 21*e*.

As shown in the figure, one end W1 of a wire rope W is connected to the base 31 and the wire rope W is attached to a pulley block 35*a* of one hook 35 (at the front) of pulley hooks 35 and 35, a pulley block 38 lifted by the crane, a pulley block 37 positioned on the opposite side of the guide frame 32 and coupled with the base 31, as well as the pulley block 35*a* of the other hook 35 of the hooks 35 and 35 while the other end of the wire rope W is linked to the base 31.

The hollow body 20 is buried by a specified amount, a pulley block 38 detached from the crane hook, the hook 35 disengaged from the holes 21*e* and 21*e* of the hollow body 20, crane hooks 39 attached to the rods 21*g* of the hollow body 20 (or to holes 21*e* and 21*e* by using different hooks, as stated above), and the hollow body 20 is withdrawn.

In the withdrawal process, the soil G1 (see FIG. 6 (*c*) in the hollow body 20 is scraped off from the discharge hole 23 into the bucket 33. When the soil G1 has been removed in its entirety the bucket 33 is detached and the soil G1 transported away.

The hollow body 20 is withdrawn from the guide frame 32 and the crane is lowered from the base 31 and the burying system 30 moved to next excavating position.

By repeating the above process, it is possible to create a continuous groove space.

Further, 40 and 40 are guide rails determining the excavating position.

In the event that the deadweight of the crane on the base 31 alone does not provide a sufficient counter force, appropriate means may be used such as underground anchors and counterweights and also elements such the hollow body already buried into the ground.

Reinforcing Bar Assembly

Figure 8:
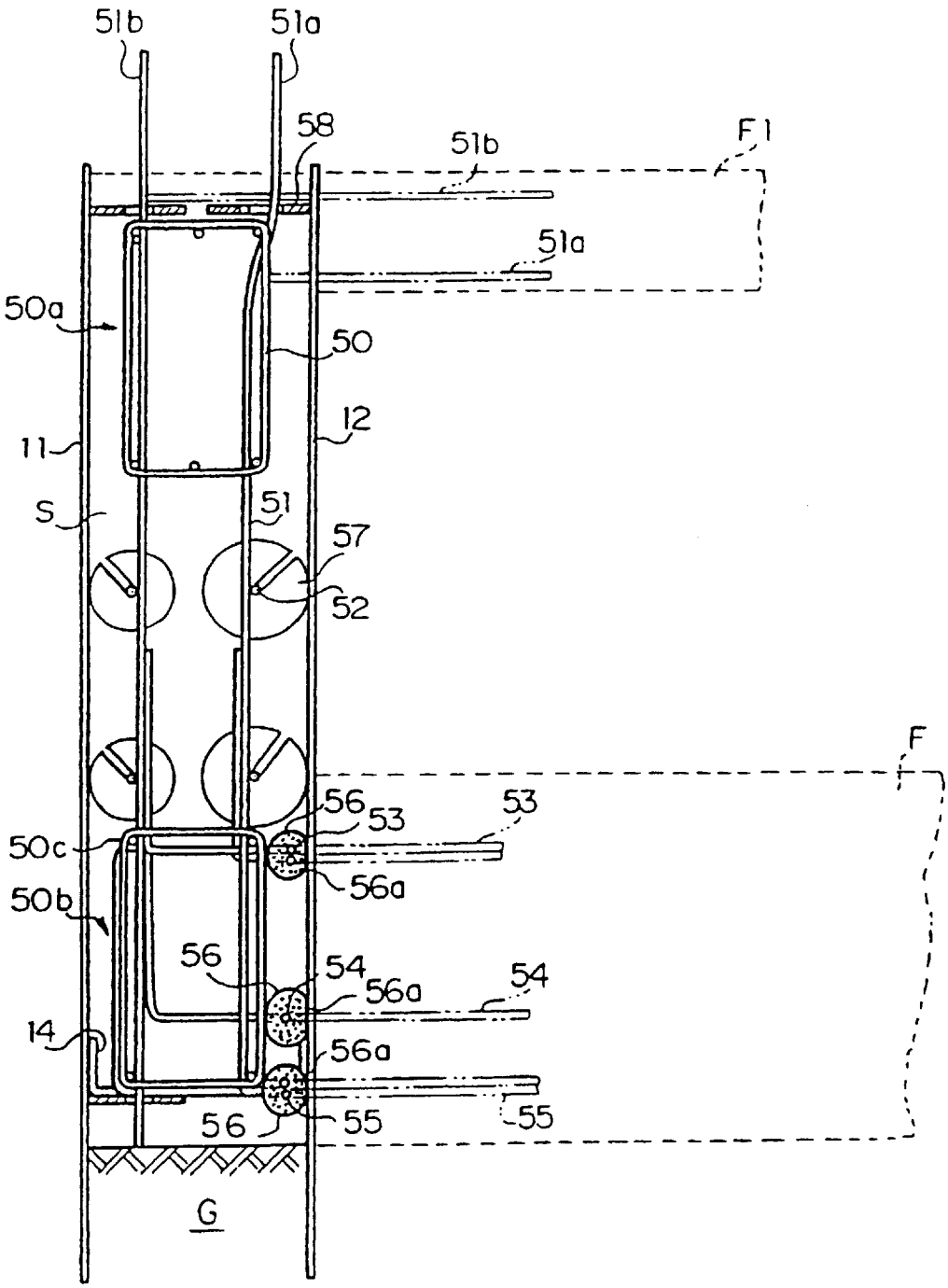
FIG. 8 is a diagram showing an arrangement of reinforcing bars.
Figure 9:
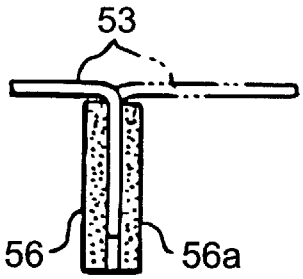
FIG. 9 is a plan view of a reinforcing assembly.

FIG. 8 shows an example of reinforcing bars and FIG. 9 is a partial plan view of FIG. 8. A reference character 50 is a reinforcing bar assembly, with bars welded to a mesh assembly. Stirrups 50*c* are arranged in the parts corresponding to beams 50*a* and 50*b* at the top and bottom of the reinforcing bar assembly 50. Reference characters 57, 58 are spacers.

The reinforcing bar assembly 50 is configured in such a manner that the reinforcing bars 53, 54, and 55 constituting the joints between the wall and floor F are capable of protruding from the wall as indicated by the imaginary lines, with a coating 56 placed in position.

As can be seen in FIG. 9, the reinforcing bars 53, 54, and 55 are bent in such a manner as to become parallel with the horizontal reinforcing bars, with the coating 56 consisting of a material such as cardboard, sponge or polystyrene foam being placed in position.

The reinforcing bar assembly 50 is located in such a manner that the coating 56 makes contact with the inner surface of plate 12 which acts as a form, and the concrete is then poured. When the plate 12 is withdrawn after the concrete has hardened the coating 56 will be exposed on the wall surface so that the coating 56 can thus be removed and the reinforcing bars 53, 54, and 55 drawn out and connected with the floor reinforcing bars.

In a case of a ceiling (i.e., a first-level floor) F1, top parts 51*a* and 51*b* of vertical reinforcing bars 51 are bent and used as joints for connection with reinforcing bars (not shown in the figure) arranged in the ceiling F1.

In FIG. 8, since the strut member 14 is pushed down to the bottom of a groove space S by the reinforcing bar assembly 50 when said reinforcing bar assembly 50 is installed, it is possible to dispense with the removal operation for the strut member.

Figure 10:
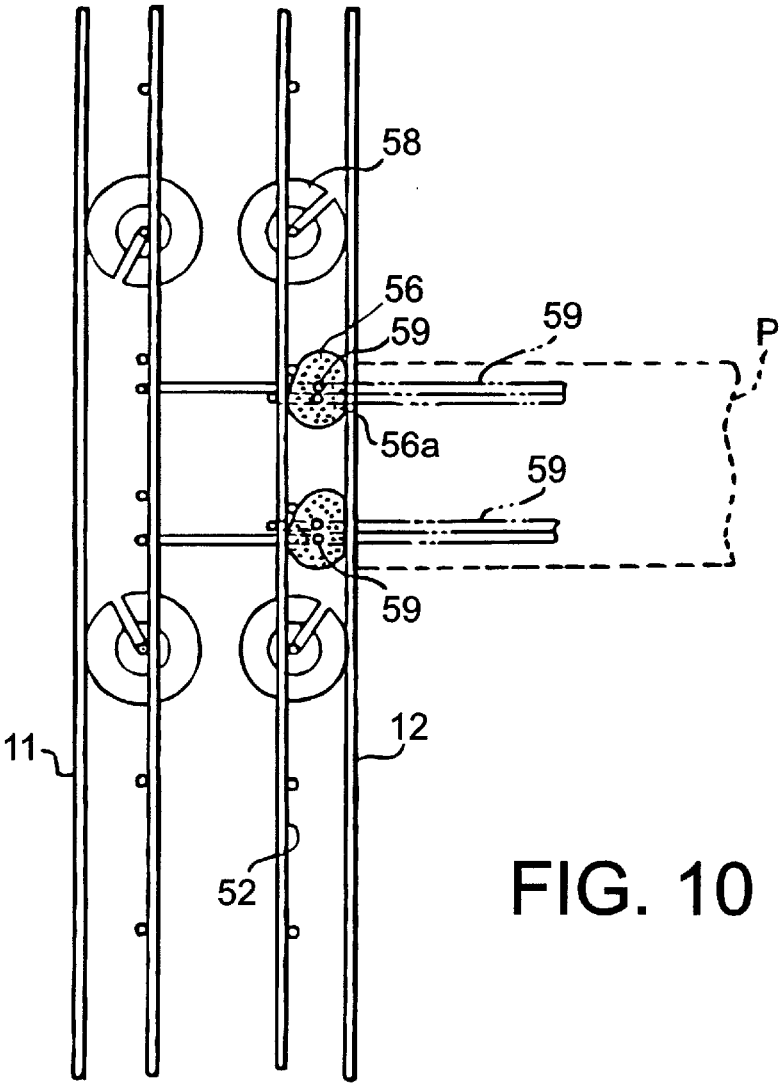
FIG. 10 is a plan view of the reinforcing assembly.

In the event that a partitioning wall P of the underground structure is formed, the reinforcing bars acting as joints are covered with the coating 56 and allowed to protrude from the wall to serve as joints. (See FIG. 10.)

Figure 11A:
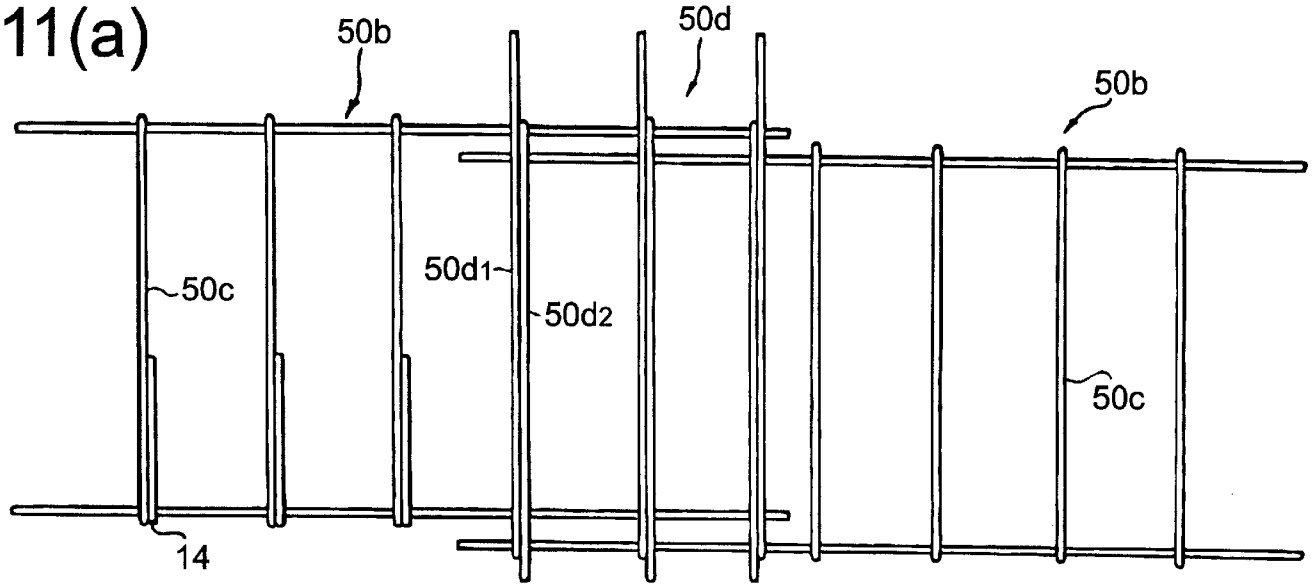
FIG. 11 is an explanatory diagram of a bottom of the reinforcing assembly shown in FIG. 8.
Figure 11B:
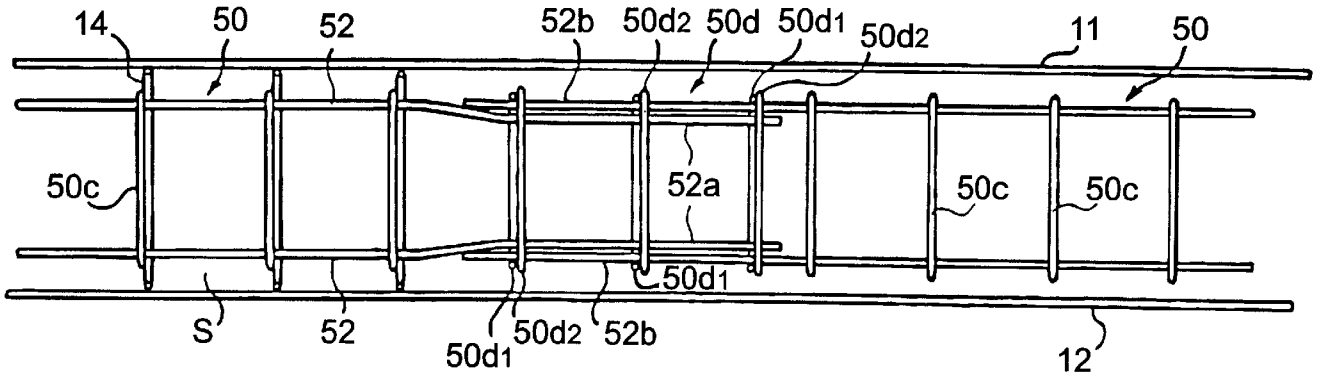

FIG. 11 shows the bottom part 50*b* of the reinforcing bar assembly 50 presented in FIG. 8, with (a) being a partial front view and (b) a partial plan view.

A connecting part 50*d* between the reinforcing bar assemblies successively inserted into the groove space S when a plural number of reinforcing bar assemblies 50 are connected is jointed by forming one end 52*a* of the horizontal reinforcing bar of the reinforcing bar assembly with a narrow width and placing the other end 52*b* of the horizontal bar of the adjacent reinforcing bar assembly 50 so that it overlaps said end 52*a*.

In the connecting part 50*d*, U-shaped auxiliary reinforcing bars 50 d1 are arranged simultaneously with the previous inserted reinforcing bar assembly 50 on the right, and auxiliary reinforcing bars 50*d*2 in the shape of an inverted U are arranged after the assembly of the reinforcing bar assembly 50 on the left, to reinforce the connecting part 50.

Reinforcing Bar Fixing Tool

Figure 12:
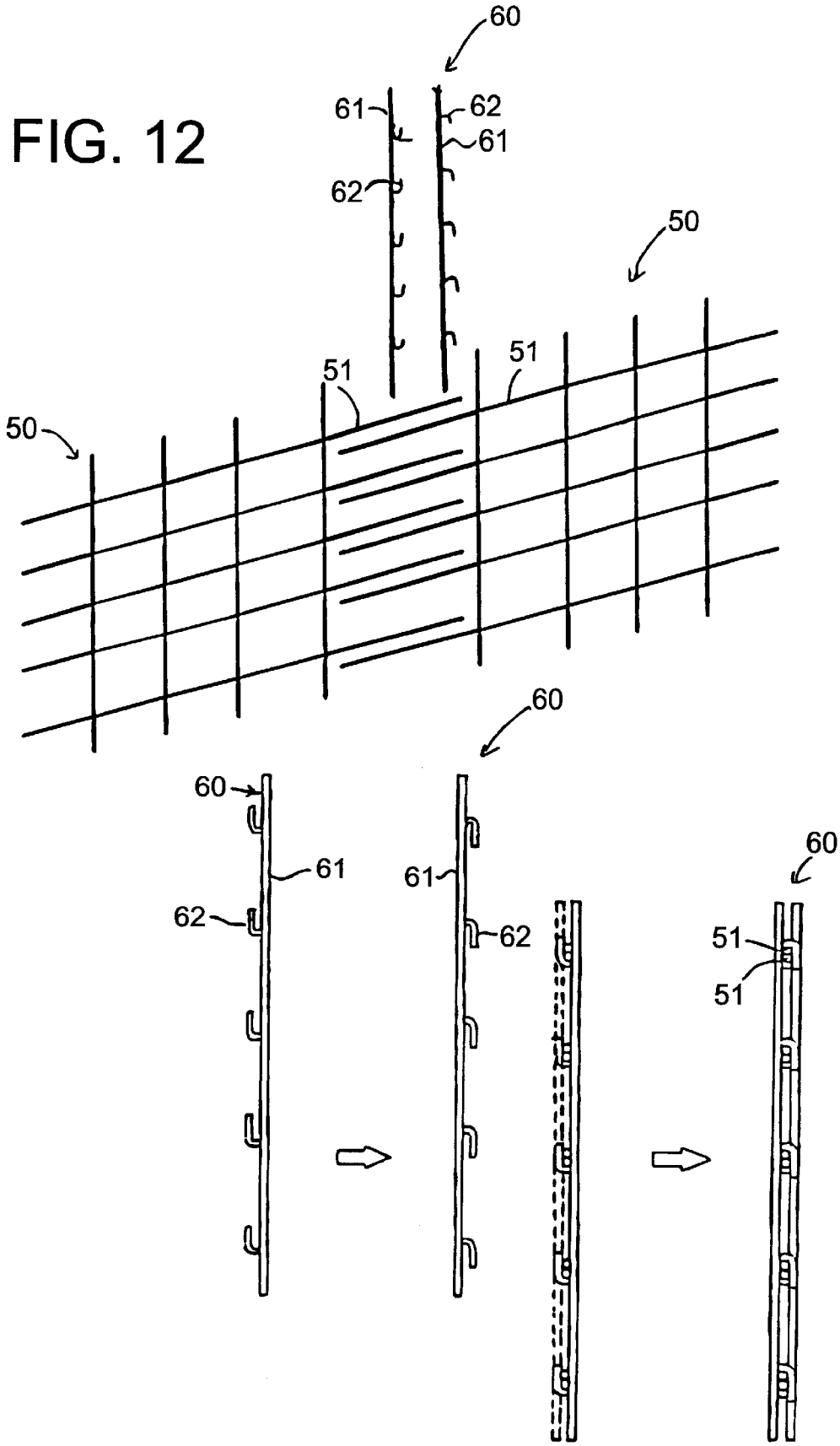
FIG. 12 is an explanatory diagram of fixtures for positioning the reinforcing members.

FIG. 12 shows a positional fixing tool 60 for positioning the horizontal reinforcing bars. The positional fixing tool 60 is designed so that in the event that the reinforcing bar assemblies are successively installed in the horizontal direction the overlap joints of the horizontal reinforcing bars will not be displaced under the pressure of the poured concrete. The positional fixing tool 60 is required since it is not possible to tie the overlap joints of the reinforcing bars together by manual operation due to the narrowness of the groove space formed in the ground. U-shaped hooks 62 are provided at a specified spacing on a vertical bar 61 and the horizontal reinforcing bars engaged in said hooks 62 by sliding the positional fixing tool 60 into the overlap joints when the reinforcing bar assembly 50 has been installed, thereby preventing movement of the horizontal bars forming the overlap joints and acting as joints retaining the horizontal bars in the specified position. The U-shaped hooks 62 are either upward or downward. The upward positional fixing tool is lowered slightly below the specified position, moved horizontally toward the horizontal reinforcing bar 51, and raised to engage the horizontal reinforcing bar 51 in hook 62. The positional fixing tool with hooks 62 facing downward is then temporarily secured above the specified position, brought close to the assembly and lowered so that the horizontal reinforcing bar 51 will engage in the hooks in such as manner that the horizontal reinforcing bar will be restrained from the top and bottom and thus prevented from movement.

It is possible to fix the reinforcing bars in position even when the fixing tools with upward or downward hooks are used on their own.

Third Embodiment of the Hollow Body

Figure 13:
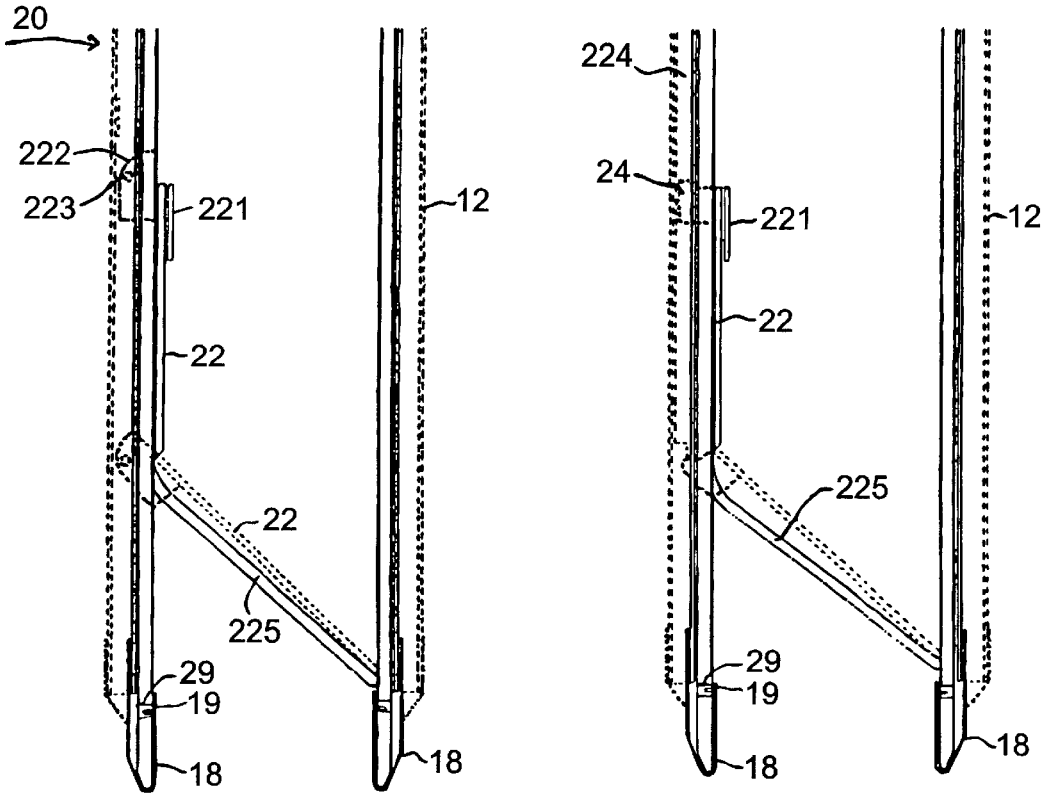
FIG. 13 is an explanatory diagram of another embodiment of the hollow body.
Figure 14:
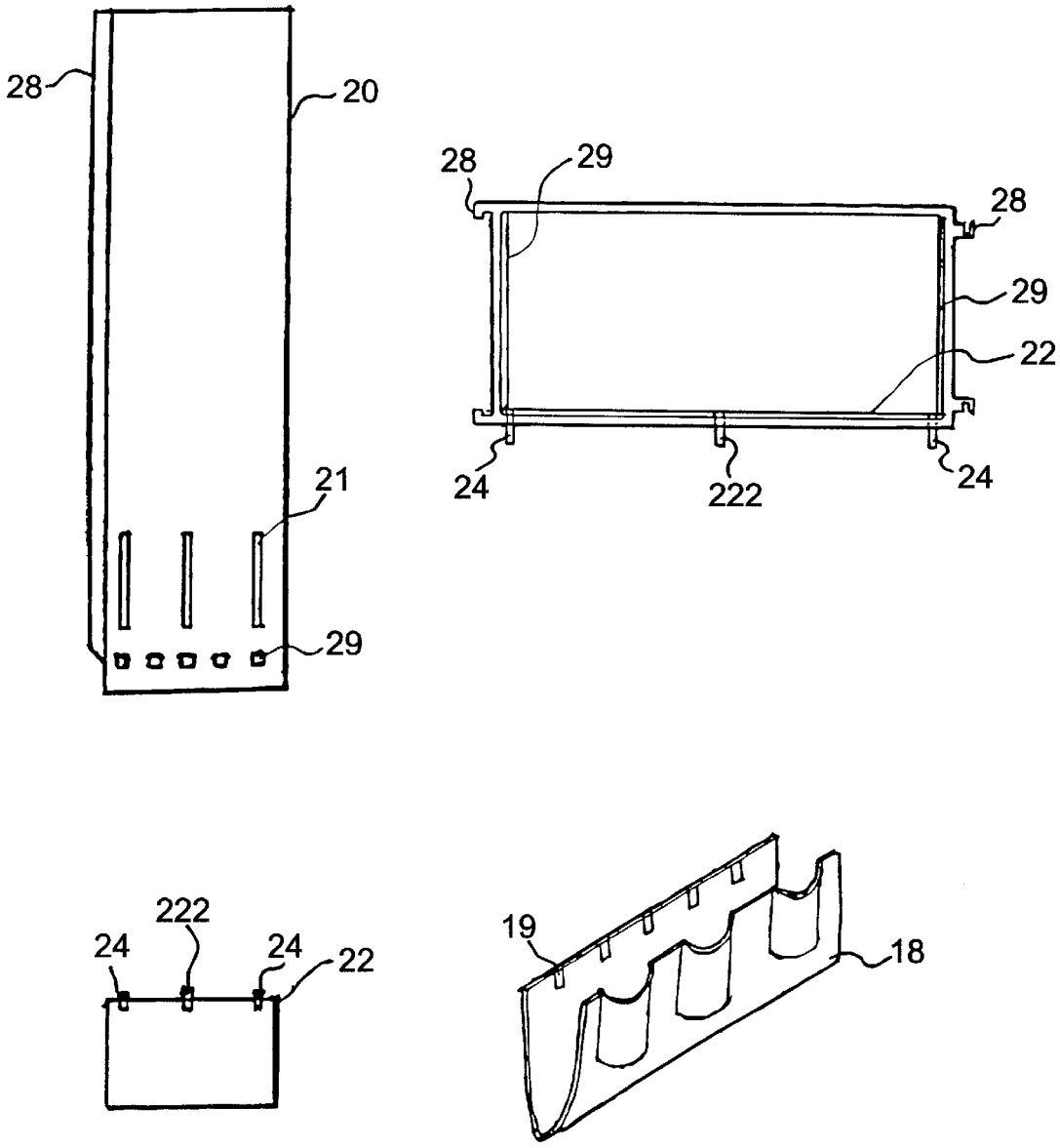
FIG. 14 is an explanatory diagram of component parts of the hollow body.

FIGS. 13 and 14 are other embodiments of the hollow body.

A shutter 22 capable of vertical movement is provided along the lateral wall of the hollow body 20. Guide joints 28 are provided on both sides of the hollow body 20 and the guide joints 28 are enmeshed with each other to determine the direction for continuously burying the hollow body 20 into the ground. At the corners, auxiliary plates are used to permit excavation at any angle, in other words, to permit changes in the direction of the wall.

Shoes 18 are mounted at the bottom edge of the hollow body 20. The shoes 18 are notched at the top and a bent protrusions 19 is fitted into holes 29 provided at the bottom of the hollow body 20 to secure it in position. The steel plate 12 temporarily secured on the outside of the hollow body 20 and the ribs thereof are covered by shoes 18 to prevent ingress of soil into the space between said steel plate 12 and the hollow body 20 and into the ribs.

In the event that the shoes 18 are not installed, the front end of the steel plate 12 is bent to prevent the ingress of soil in like manner.

The shutter 22 is a plate designed to seal off the bottom of the hollow body 20 and mounted along the lateral wall of the hollow body 20, with push-down supports 24

Figure 15:
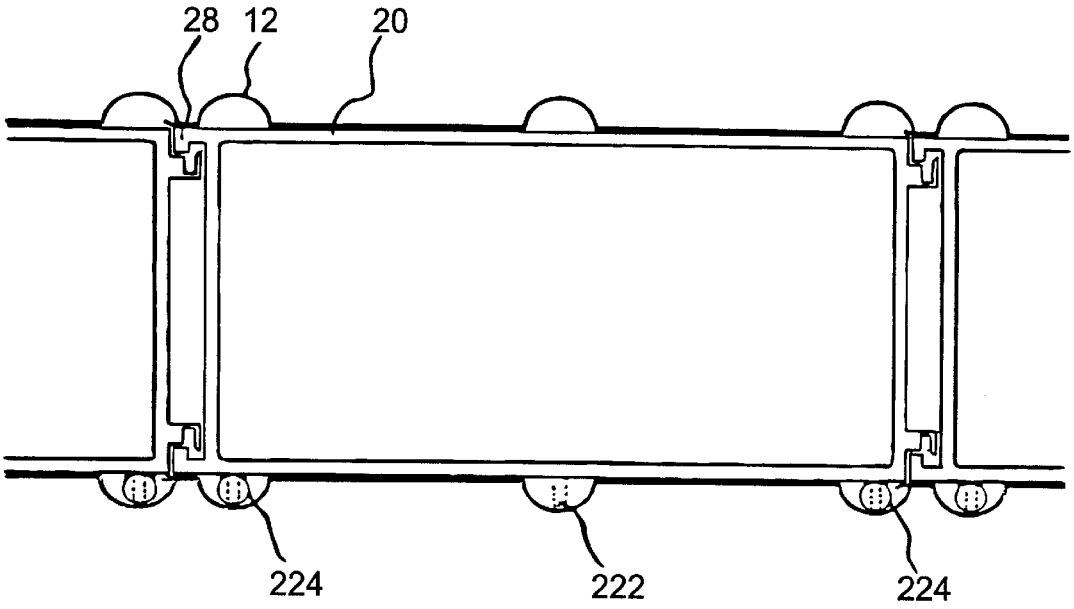
FIG. 15 is an explanatory diagram of the excavation procedure.

As shown in FIG. 15, the steel plate 12 with semicircular ribs is temporarily fastened on the first hollow body 20 and buried into the ground to the specified depth, whereupon the second and third hollow bodies are buried by engaging the guide joints 28 on both sides of the first hollow body. These guide joints 28 ensure that there can be no directional out-of-true.

The shutter 22 of the first hollow body 20 in the middle is pushed down from the ground surface by a rod 224 pressing against a support 24. The pushed-down shutter 22 is guided by a guides 221 on both sides and changes orientation toward the horizontal direction when contacting a guide 225 provided at the bottom on both sides of the hollow body 20, thereby shutting the bottom of the hollow body.

The first hollow body 20 is then pulled up to the ground surface while making provision to retain the steel plate 12 and prevent its simultaneous lift-up with the hollow body 20, with said steel plate 12 being left in situ underground to serve as a form and earth-retaining sheathing. Using a hole 223 of a protruding part 222 in the center of the shutter 22 of the drawn-up hollow body 20, the bottom of the shutter 22 is opened by pulling it back into its original position to discharge the soil collected in the interior of the hollow body 20.

The steel plate 12 that has been left underground is supported on both sides by the second and third hollow bodies 20 and therefore stable and self-standing. If necessary, a strut member may be installed between the plates.

After the soil has been emptied out, the hollow body 20 can be buried again by engaging it into the guide joint 28 of the second hollow body 20 which has been left in situ underground. By repeating this procedure it is possible successively to create the required groove space underground.

Reinforcing bars are arranged in the groove space thus formed underground and concrete is poured therein so as to construct the wall of the underground structure.

Method of Formation of a Corner

Figure 16:
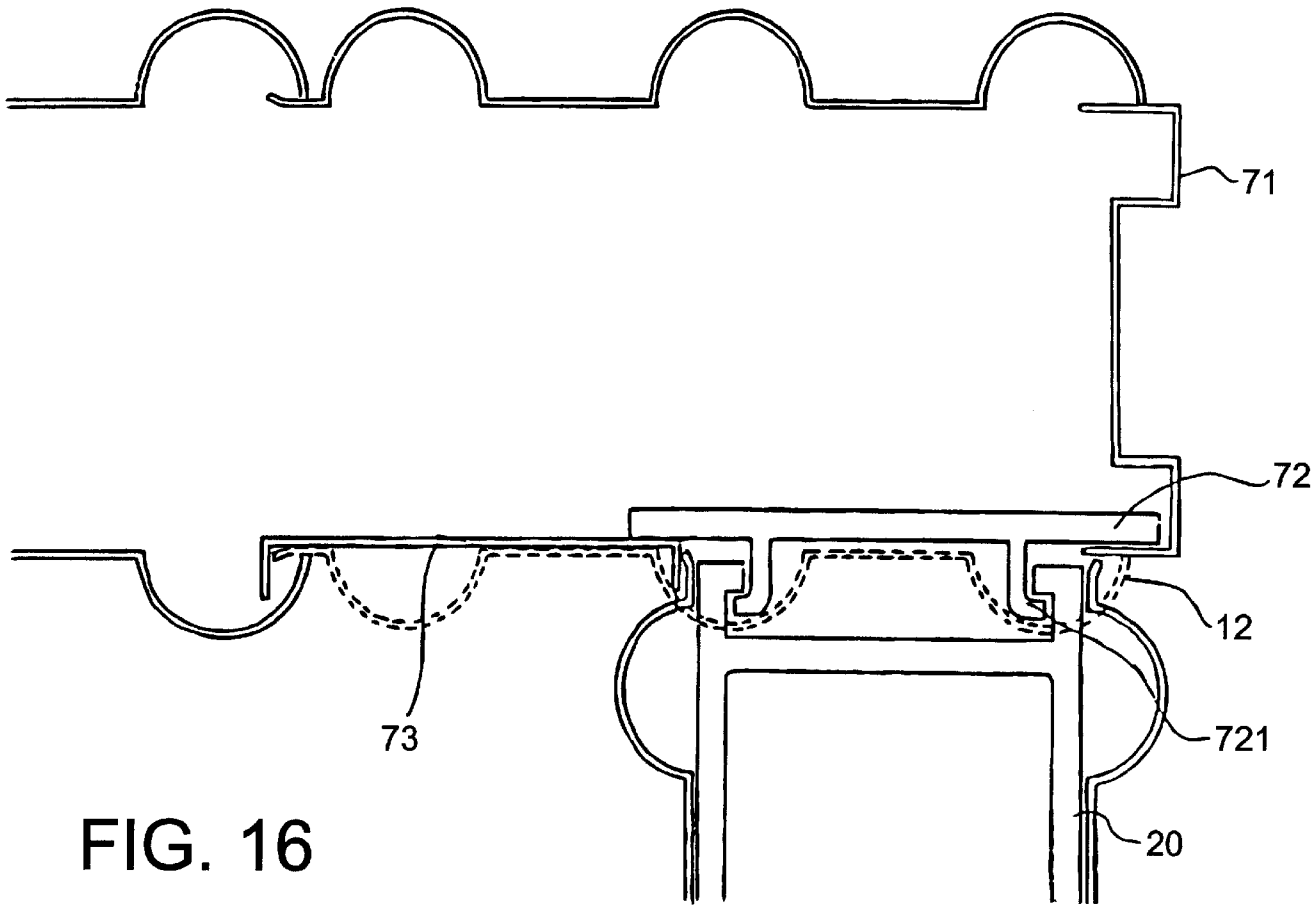
FIG. 16 is an explanatory diagram showing an execution of rectangular corners.

When a corner is constructed, an end-face auxiliary plate 71 is inserted into the edge guide joint of the hollow body 20 to retain the edges of the excavated groove space, as shown in FIG. 16. As can be seen in the figure, the end-face auxiliary plate 71 may be a steel plate with channeled reinforcements on both sides or a flat steel plate.

After drawing up the hollow body 20, a jointing plate 72 is position on the side on which the new groove space is to be formed and a lateral reinforcing plate 73 is positioned to the side of said jointing plate 72 to prevent the wall face from collapsing, and the steel plate 12 indicated by dotted lines is withdrawn. The jointing plate 72 is provided in matching joint systems to fit both the male and female guide joints provided on the hollow body, so that it can accommodate either type of guide joint. The plate shown in the figure corresponds to a female joint, with the bent-over joint half 721 protruding in two locations on the outside from the plate.

By burying the new hollow body 20 by making use of a joint half 721 of the jointing plate 72, it is possible to form rectangular corners.

Figure 17:
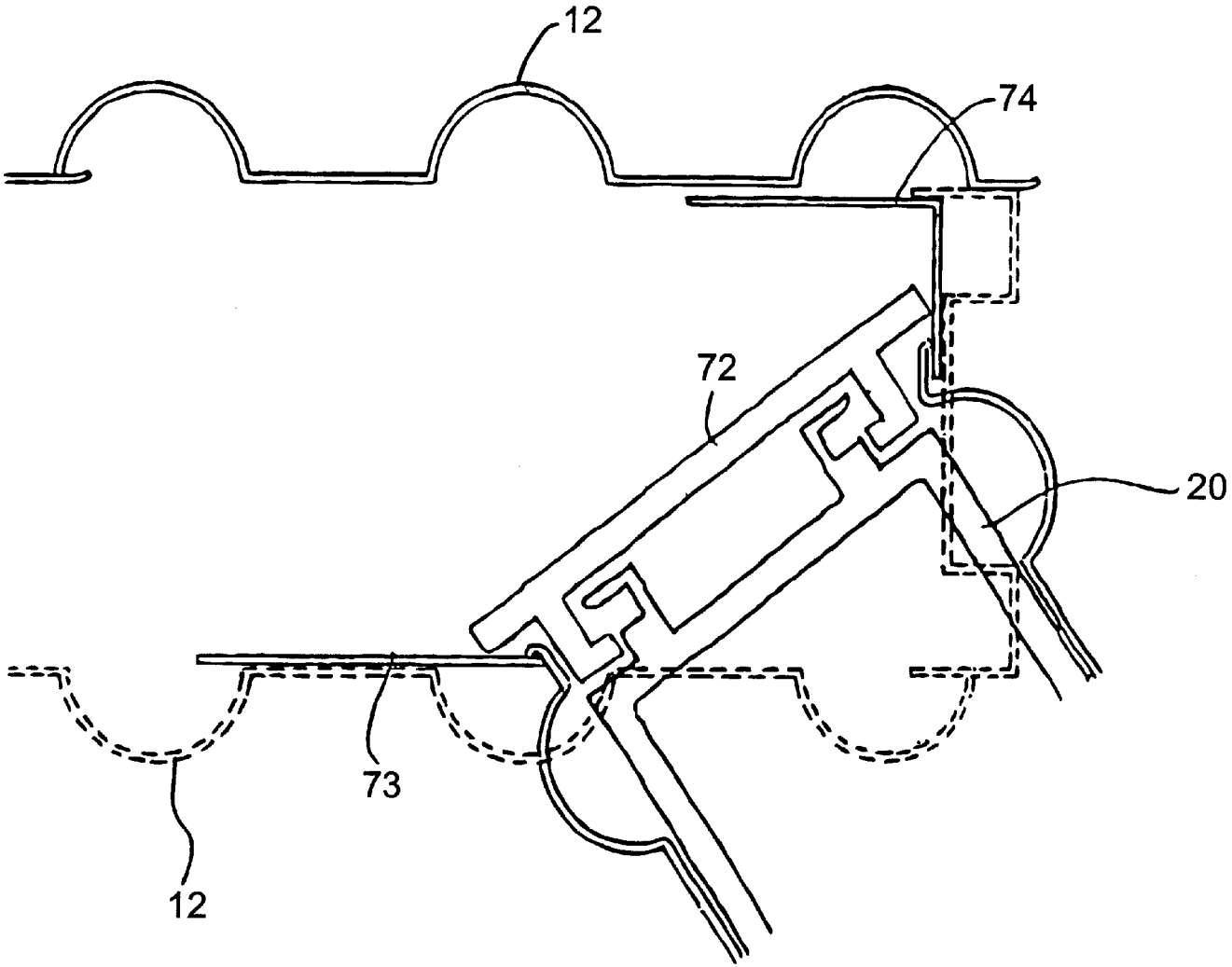
FIG. 17 is an explanatory diagram showing the execution of corners at any angle.

As shown in FIG. 17, an auxiliary corner plate 74 is driven into the ground instead of the end-face auxiliary plate 71 when non-rectangular corners are formed and the end face of the excavated groove is retained and the jointing plate 72 buried by aligning it with the angle of the corner. On the side on which the groove space is formed the lateral auxiliary plate 73 is positioned and the steel plate 12 withdrawn.

The new hollow body 20 is buried by bring it in mesh with the jointing plate 72 to permit the formation of corners at any angle.

What is claimed is:

1. A method for constructing an underground structure which comprises: fastening plates temporarily on a hollow body being provided with guide joints on lateral sides of the hollow body, burying a plurality of the hollow bodies connected by the guide joints into the ground simultaneously and conjointly with the plates, withdrawing the hollow bodies with soil retained therein to form a groove space in the ground while leaving the plates in the ground, and pouring concrete into the groove space by using the plates as formworks.

2. The method for constructing an underground structure in claim 1, further comprising loosening said ground prior to burying said plates into the ground.

3. The method for constructing an underground structure in claim 1, wherein the step of burying hollow bodies includes burying an array of at least three hollow bodies into said ground and the step of withdrawing the hollow bodies includes withdrawing the hollow body in the middle first.

4. The method for constructing an underground structure in claim 1, further comprising loosening said ground prior to burying said hollow body into the ground.

5. A method for constructing an underground structure comprising:

burying plates on either side of a hollow body into ground simultaneously and conjointly with the hollow body;

withdrawing the hollow body with soil retained therein to form a groove space in the ground while leaving the plates in the ground; and pouring concrete into the groove space by using the plates as formworks.

6. The method for constructing an underground structure according to claim 5, further comprising providing guide joints at edges of the plates to permit the hollow body to be connected to another hollow body in burying the plate with the hollow body into the ground in array.

7. The method for constructing an underground structure according to claim 5, further comprising providing guide joints at lateral sides of the plates to permit the hollow body to be connected to another hollow body in burying the plate with the hollow body into the ground in array.

8. The method for constructing an underground structure according to claim 5, further comprising providing a shutter at a bottom of the hollow body to be opened when the hollow body is buried into the ground and to be closed when the hollow body is withdrawn with soil contained therein.

9. The method for constructing an underground structure according to claim 5, further comprising constructing formworks in an array by repeating a process that an array of at least three hollow bodies is buried into said ground and the hollow body in the middle is withdrawn first.

* * * * *